US012178235B2

(12) United States Patent
Bonnely et al.

(10) Patent No.: US 12,178,235 B2
(45) Date of Patent: Dec. 31, 2024

(54) MULTI-SEGMENT COMPONENT WITH INTUMESCENT COATING

(71) Applicant: Philip Morris Products S.A., Neuchatel (CH)

(72) Inventors: Samuel Bonnely, Neuchatel (CH); Anna Canal Ponsico, Neuchatel (CH); Fabien Duc, Neuchatel (CH); Giuseppe Gaudio, Neuchatel (CH); Simon Nussbaumer, Neuchatel (CH); Lucien Suarez, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 1024 days.

(21) Appl. No.: 17/055,796

(22) PCT Filed: May 16, 2019

(86) PCT No.: PCT/EP2019/062722
§ 371 (c)(1),
(2) Date: Nov. 16, 2020

(87) PCT Pub. No.: WO2019/219869
PCT Pub. Date: Nov. 21, 2019

(65) Prior Publication Data

US 2021/0127735 A1 May 6, 2021

(30) Foreign Application Priority Data

May 17, 2018 (EP) ..... 18173052

(51) Int. Cl.
*A24B 15/16* (2020.01)
*A24D 1/02* (2006.01)
(Continued)

(52) U.S. Cl.
CPC ..... *A24B 15/165* (2013.01); *A24D 1/02* (2013.01); *A24D 1/042* (2013.01); *A24D 1/22* (2020.01)

(58) Field of Classification Search
CPC ... A24D 1/22; A24D 1/02; A24D 1/10; A24B 15/165
See application file for complete search history.

(56) References Cited

U.S. PATENT DOCUMENTS 5,040,552 A 8/1991 Schleich et al.
5,595,577 A 1/1997 Bensalem et al.
(Continued)

FOREIGN PATENT DOCUMENTS

CN 105828647 A 8/2016
CN 106659246 A 5/2017
(Continued)

OTHER PUBLICATIONS

International Search Report and Written Opinion issued on Jul. 30, 2019 in PCT/EP2019/062722 filed on May 16, 2019.
(Continued)

*Primary Examiner* — Michael H. Wilson
*Assistant Examiner* — Stephanie Lynn Moore
(74) *Attorney, Agent, or Firm* — Oblon, McClelland, Maier & Neustadt, L.L.P.

(57) ABSTRACT

A multi-segment component for an aerosol-generating article is provided, the multi-segment component including: a combustible heat source; an aerosol-forming substrate downstream of the combustible heat source; and a wrapper circumscribing a rear portion of the combustible heat source and at least a front portion of the aerosol-forming substrate, a front portion of the combustible heat source extending beyond the wrapper so that the front portion of the combustible heat source is exposed during use; and an intumes-
(Continued)

cent coating on all or part of the front portion of the combustible heat source, the intumescent coating being configured to form a heat insulating layer on the front portion of the combustible heat source in response to heating by the combustible heat source.

15 Claims, 6 Drawing Sheets

(51) Int. Cl.
*A24D 1/04* (2006.01)
*A24D 1/22* (2020.01)

(56) References Cited

U.S. PATENT DOCUMENTS

| | | | | |
|---|---|---|---|---|
| 2011/0180082 | A1* | 7/2011 | Banerjee | A24D 1/002 131/194 |
| 2015/0216231 | A1 | 8/2015 | Roudier et al. | |
| 2017/0303585 | A1* | 10/2017 | Florack | A24F 42/60 |
| 2019/0000142 | A1* | 1/2019 | Lavanchy | A24D 3/17 |
| 2019/0029314 | A1 | 1/2019 | Malgat et al. | |

FOREIGN PATENT DOCUMENTS

| | | | |
|---|---|---|---|
| EP | 2 210 509 | A1 | 7/2010 |
| JP | 2015-527073 | A | 9/2015 |
| JP | 2017-532031 | A | 11/2017 |
| RU | 2 632 277 | C2 | 10/2017 |
| RU | 2 637 980 | C2 | 12/2017 |
| WO | WO 2009/022232 | A2 | 2/2009 |
| WO | WO 2013/072336 | A1 | 5/2013 |
| WO | WO 2014/037270 | A1 | 3/2014 |
| WO | WO 2014/086998 | A1 | 6/2014 |
| WO | WO 2015/101595 | A1 | 7/2015 |
| WO | WO 2015/197850 | A1 | 12/2015 |
| WO | WO 2016/050706 | A1 | 4/2016 |
| WO | WO 2016/156424 | A1 | 10/2016 |
| WO | WO 2016/156437 | A1 | 10/2016 |
| WO | WO 2017/042297 | A1 | 3/2017 |
| WO | WO 2017/042298 | A1 | 3/2017 |
| WO | WO 2017/114683 | A1 | 7/2017 |
| WO | WO 2017/115196 | A1 | 7/2017 |
| WO | WO 2017/207672 | A1 | 12/2017 |
| WO | WO 2017/207673 | A1 | 12/2017 |

OTHER PUBLICATIONS

Combined Russian Office Action and Search Report issued Sep. 5, 2022, in corresponding Russian Patent Application No. 2020140652/03(075647) (with English Translation), 13 pages.

Notice of Grounds for Rejection issued Mar. 20, 2023 in Japanese Patent Application No. 2020-558448 (with English language translation), 12 pages.

"Thermal Ceramics Solutions; Fibre, Refractory & Microporous Insulation", Morgan Ceramics, 2019, 28 pages http://www.morganfireprotection.com/en-gb/products/firemaster-expanding-felt/.

Combined Chinese Office Action and Search Report issued Aug. 23, 2023, in corresponding Chinese Patent Application No. 201980027826.8 (with English Translation), 16 pages.

* cited by examiner

MULTI-SEGMENT COMPONENT WITH INTUMESCENT COATING

The present invention relates to a multi-segment component for an aerosol-generating article. In particular, the present invention relates to a multi-segment component having a combustible heat source for heating an aerosol-forming substrate downstream of the combustible heat source, and a wrapper circumscribing at least a rear portion of the combustible heat source. The present invention also relates to aerosol-generating articles comprising such multi-segment components.

A number of smoking articles in which tobacco is heated rather than combusted have been proposed in the art. An aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to a physically separate aerosol-forming substrate, such as a tobacco-containing substrate. The aerosol-forming substrate may be located within, around or downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

For example, WO 2009/022232 A2 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate. The combustible heat source and the aerosol-forming substrate are in abutting coaxial alignment and, along with the heat-conducting element, are overwrapped in an outer wrapper of cigarette paper of low air permeability to hold the various components of the smoking article together. In use, the front portion of the aerosol-forming substrate is heated primarily by conduction through the abutting rear portion of the combustible heat source and via the heat-conducting element.

During use of aerosol-generating articles in which an aerosol-forming substrate, for example tobacco is heated rather than combusted, the combustible heat source may reach a temperature significantly higher than the temperatures reached in the combustion zone of a combustible cigarette. For example, the combustible heat source of a heated aerosol-generating article may reach an average temperature of around 500 degrees Celsius and, in certain cases, the temperature of the combustible heat source may reach up to about 800 degrees Celsius. Furthermore, even once the combustible heat source of a heated aerosol-generating article has finished combusting, it may remain at a high temperature for an extended period after the user has finished using the aerosol-generating article. As a result, improper handling of the aerosol-generating article may cause heat damage to adjacent materials.

It would therefore be desirable to provide a multi-segment component for an aerosol-generating article comprising a combustible heat source in which the risk of heat damage to adjacent articles caused by the combustible heat source in reduced.

According to a first aspect of the present invention, there is provided a multi-segment component for an aerosol-generating article, the multi-segment component comprising: a combustible heat source; an aerosol-forming substrate downstream of the combustible heat source; and a wrapper circumscribing a rear portion of the combustible heat source and at least a front portion of the aerosol-forming substrate; wherein a front portion of the combustible heat source extends beyond the wrapper so that the front portion of the combustible heat source is exposed during use, and wherein the multi-segment component further comprises an intumescent coating on all or part of the front portion of the combustible heat source, the intumescent coating being configured to form a heat insulating layer on the front portion of the combustible heat source in response to heating by the combustible heat source.

In multi-segment components according to the present invention, the intumescent coating forms a heat insulating layer on the outer surface of the combustible heat source in use to reduce heat transfer from the combustible heat source to materials that the front portion of the combustible heat source may come into contact with. This reduces the temperature of the external surface of an aerosol-generating article comprising the multi-segment component in the region of the front portion of the combustible heat source in comparison to arrangements in which the front portion of the combustible heat source is not provided with an intumescent coating. This advantageously facilitates a reduction in the potential risk of heat damage to adjacent materials caused by improper handling of the aerosol-generating article. For example, where the aerosol-generating article is placed with the combustible heat source resting on a combustible material, the intumescent coating may reduce the likelihood of damage to the combustible material caused by the heat from the combustible heat source. The insulating layer forms a thermal barrier on the front portion of the combustible heat source. The insulating layer may form an ignition propensity barrier on the front portion of the combustible heat source. The insulating layer may thermally isolate the front portion of the combustible heat source when the combustible heat source is hot.

As used herein with reference to the invention, the term "intumescent" describes a material which expands upon exposure to elevated temperatures, other than only as a result of its coefficient of thermal expansion.

As used herein with reference to the invention, the term "intumescent coating" describes a coating comprising an intumescent material.

As used herein with reference to the invention, the term "aerosol-forming substrate" is used to describe a substrate capable of releasing upon heating volatile compounds, which can form an aerosol. The aerosols generated from aerosol-forming substrates of multi-segment components according to the invention may be visible or invisible and may include vapours (for example, fine particles of substances, which are in a gaseous state, that are ordinarily liquid or solid at room temperature) as well as gases and liquid droplets of condensed vapours.

The rear portion of the combustible heat source is the portion of the combustible heat combustible heat source which is circumscribed by the wrapper during use of the multi-segment component. The front portion of the combustible heat source is the portion of the combustible heat source which extends beyond the wrapper so that it is exposed during use. The front portion of the combustible heat source is upstream of the rear portion of the combustible heat source.

The combustible heat source may comprise a circumferential surface, a front end face, and a rear end face.

As used herein with reference to the invention, the term "circumferential surface" refers to the surface of the combustible heat source, or any other component of the multi segment-component, which extends in the longitudinal direction. The circumferential surface does not include the end faces of components, such as the front end face of the combustible heat source.

The intumescent coating may be provided on all or part of the circumferential surface of the front portion of the combustible heat source. Where this is the case, the intumescent coating may also be provided on all or part of the front end face of the combustible heat source. Alternatively, where this is the case the front end face of the combustible heat source may be free from any intumescent coating.

The intumescent coating may be provided on all or part of the front end face of the combustible heat source. Where this is the case, the intumescent coating may also be provided on all or part of the circumferential surface of the front portion of the combustible heat source. Alternatively, where this is the case the circumferential surface of the front portion of the combustible heat source may be free from any intumescent coating.

As used herein with reference to the invention, the terms "circumscribe" and "circumscribing" are given their usual meanings to mean "extending around the entire circumference". Thus, by "circumscribing" the rear portion of the combustible heat source, the wrapper extends around the entire circumference of the combustible heat source at the rear portion of the combustible heat source. The combustible heat source may have any shape and does not need to have a circular cross section. The combustible heat source may have a circular cross section.

As used herein with reference to the invention, the terms "upstream" and "downstream", are used to describe the relative positions of components, or portions of components of the multi-segment component and the aerosol-generating article. The combustible heat source is towards the upstream end of the multi-segment component and the aerosol-forming substrate is towards the downstream end of the multi-segment component.

During use of the multi-segment component, the front portion of the combustible heat source extends beyond a front edge of the wrapper such that the surface of the front portion of the combustible heat source, or any intumescent coating provided on the front portion of the combustible heat source, forms an external surface of an aerosol-generating article incorporating the multi-segment component. As described below, the multi-segment component may comprise a removable wrap or cap which covers the front portion of the combustible heat source and which is removed prior to use to expose the front portion of the combustible heat source.

As used herein with reference to the invention, the term "ignition propensity" refers to the tendency of aerosol-generating articles, such as smoking articles, to cause a material on which they lie to ignite. The ignition propensity may be measured according to ISO 12863:2010(E).

In use, the combustible heat source temperature rises during ignition and combustion to an elevated temperature range. The intumescent coating provided on the front portion of the combustible heat source expands in response to the elevated temperature. The expanded intumescent coating forms a barrier between the combustible heat source and material with which the front portion of the combustible heat source is placed in contact.

The reduction in the density of the intumescent coating may increase the thermal insulation properties of the intumescent coating, thereby reducing the temperature of the outer surface of the multi-segment component. This may advantageously reduce the risk of potential heat damage to adjacent materials during use of an aerosol-generating article comprising the multi-segment component.

The intumescent coating may be in direct contact with all or part of the front portion of the combustible heat source.

The intumescent coating may circumscribe the front portion of the combustible heat source.

The intumescent coating may be applied to the front portion of the combustible heat source by any suitable method. For example, the intumescent coating may be provided on the front portion of the combustible heat source by one or more of spreading, spray coating, dip coating, using a glue gun, using a brush or a roller, using a nozzle, or rotogravure or other printing techniques. Where the intumescent material is a powder, it may be glued to the front portion of the combustible heat source using a glue or a binder.

The intumescent coating may be provided on substantially the entire outer surface of the front portion of the combustible heat source.

As used herein with reference to the invention, the term "substantially the entire outer surface" is used to mean that the coating is provided on at least 80 percent of the circumferential surface area of the front portion of the combustible heat source. For example, the coating may be provided on at least 90 percent of the circumferential surface area of the front portion of the combustible heat source, at least 95 percent of the circumferential surface area of the front portion of the combustible heat source, or at least 99 percent of the circumferential surface area of the front portion of the combustible heat source. The coating may be provided on the entire circumferential surface area of the front portion of the combustible heat source.

As used herein with reference to the invention, the term "longitudinal" refers to a direction between the upstream end of the multi segment-component and the downstream end of the multi segment-component.

As used herein with reference to the invention, the term "transverse", "radial", or "radially" refers to a direction perpendicular to the longitudinal direction of the multi segment-component.

The provision of an intumescent coating on substantially the entire outer surface of the front portion of the combustible heat source may advantageously facilitate the formation of an effective insulating layer. This may help to minimise heat transfer from the front portion of the combustible heat source.

Part of the front portion of the combustible heat source may be free from any intumescent coating. This may advantageously facilitate ignition of the combustible heat source. For example, at least about 15% of the surface area of the front portion of the combustible heat source may be free from any intumescent coating, that is the intumescent coating may be provided on no more than about 85% of the surface area of the front portion of the combustible heat source.

The front end face of the combustible heat source may be free from any intumescent coating.

The intumescent coating may be provided on the front end face of the combustible heat source. Where the intumescent coating is provided on substantially the entire outer surface of the front portion of the combustible heat source, the intumescent coating may also be provided on all or part of the front end face of the combustible heat source. For example, the intumescent coating may also be provided on substantially the entire front end face of the combustible heat source. Alternatively, where the intumescent coating is provided on substantially the entire outer surface of the front portion of the combustible heat source, the front end face of the combustible heat source may be free from any intumescent coating. This may facilitate ignition of the combustible heat source by the user, in particular where the intumescent coating is formed from a material which might hinder ready ignition of the combustible heat source.

The intumescent coating may be provided in a discontinuous pattern on the front portion of the combustible heat source.

As used herein with reference to the invention, the term "discontinuous pattern" refers to an arrangement of lines or shapes of intumescent coating in which intervals or spaces in the coating exist between adjacent regions of the pattern. For example, such a pattern may comprise a plurality of discrete lines or shapes which are entirely spaced apart. Such a pattern may comprise a grid of lines or shapes which intersect but which also define uncoated regions in the spaces between adjacent lines or shapes.

The provision of an intumescent coating provided in a discontinuous pattern on the front portion of the combustible heat source may advantageously allow for controlled expansion of the intumescent coating when it is exposed to elevated temperatures. For example, the discontinuous pattern may provide space for the intumescent coating to expand such that the intumescent coating may at least partially fills the gaps between adjacent parts of the discontinuous pattern when it expands, rather than expanding radially outwards. This may improve the appearance of aerosol-generating articles incorporating multi-segment components according to the invention.

The use of a discontinuous pattern may help to provide the user with a simple visual indication of when the intumescent coating has expanded to form the heat insulating layer. For example, when the gaps between adjacent parts of the discontinuous pattern can be seen to reduce in size, or where adjacent parts of the discontinuous pattern expand into contact.

Where the intumescent coating is provided in a discontinuous pattern on the front portion of the combustible heat source, the intumescent coating may also be provided on substantially the entire outer surface of the front portion of the combustible heat source. In this case, the discontinuous pattern, including any intervals or spaces, is provided on at least 80 percent of the circumferential surface area of the front portion of the combustible heat source as described above.

Where the intumescent coating is provided on substantially the entire outer surface of the front portion of the combustible heat source in a discontinuous pattern, the intumescent coating may also be provided on all or part of the front end face of the combustible heat source. The intumescent coating provided on all or part of the front end face of the combustible heat source may be provided in a discontinuous pattern. Alternatively, the intumescent coating provided on all or part of the front end face of the combustible heat source may be provided as a continuous layer.

As used herein with reference to the invention, the term "continuous layer" refers to an unbroken arrangement of the intumescent coating in which the intumescent coating does not include any intervals or spaces separating portions of the intumescent coating.

Where the intumescent coating is provided on substantially the entire outer surface of the front portion of the combustible heat source in a discontinuous pattern, the front end face of the combustible heat source may be free from any intumescent coating.

The intumescent coating may be provided on all or part of the front end face of the combustible heat source in a discontinuous pattern. Where this is the case, the intumescent coating may also be provided on all or part of the outer surface of the front portion of the combustible heat source. The intumescent coating provided on all or part of the circumferential surface of the front portion of the combustible heat source may be provided in a discontinuous pattern. Alternatively, the intumescent coating provided on all or part of the circumferential surface of the front portion of the combustible heat source may be provided as a continuous layer.

Where the intumescent coating is provided on all or part of the front end face of the combustible heat source in a discontinuous pattern, the circumferential surface of the front portion of the combustible heat source may be free from any intumescent coating.

The discontinuous pattern may be any discontinuous pattern. The discontinuous pattern may comprise one or more lines, rings, dots, or other discrete geometric shapes of intumescent material, or any combination thereof. The discontinuous pattern may be a regular pattern. The discontinuous pattern may be an irregular pattern.

The intumescent coating may be provided only on the front portion of the combustible heat source.

This may advantageously allow the configuration of the intumescent coating to be optimised for thermal performance of the intumescent coating without the need for any consideration of the effect of the expansion of the intumescent coating on the wrapper. This may simplify the manufacture of the multi-segment component.

Providing the intumescent coating only on the front portion of the combustible heat source may reduce the risk of the intumescent coating affecting the fixation of the combustible heat source within the wrapper.

The intumescent coating may be provided on substantially the entire length of the combustible heat source.

As used herein with reference to the invention, the term "substantially the entire length of the combustible heat source" is used to mean that the intumescent coating is be provided on at least 80 percent of the length of the combustible heat source. For example, the intumescent coating may be provided on at least 90 percent of the length of the combustible heat source, at least 95 percent of the length of the combustible heat source, or at least 99 percent of the length of the combustible heat source. The coating may be provided on the entire length of the combustible heat source.

The intumescent coating may be provided on substantially the entire length of the combustible heat source but not on substantially the entire outer surface of the combustible heat source. For example, the intumescent coating may be provided as a single longitudinal stripe extending the entire length of the combustible heat source but not having a thickness sufficient to cover substantially the entire outer surface of the combustible heat source.

The intumescent coating may be provided on substantially the entire length of the combustible heat source and on substantially the entire outer surface of the combustible heat source.

Providing the intumescent coating on substantially the entire length of the combustible heat source may advantageously facilitate application of the coating on the heat source. The intumescent coating may improve retention of the combustible heat source within the wrapper during or after combustion of the combustible heat source. This may facilitate correct positioning of the heat source relative to the aerosol-forming substrate. The expanded intumescent coating may compensate for expansion of the wrapper as a result of the thermal expansion coefficient of the wrapper and for the surface roughness of the combustible heat source. This may facilitate a reduction in the bypass of combustion gases around the heat source and may further improve retention of the combustible heat source within the wrapper.

Where the intumescent coating is provided on substantially the entire length of the combustible heat source, the portion of the intumescent coating provided on the front portion of the combustible heat source may be in a discontinuous pattern while the portion of the intumescent coating provided on the rear portion of the combustible heat source may be provided as a continuous layer. Alternatively, the portion of the intumescent coating provided on the rear portion of the combustible heat source may be provided in a discontinuous pattern. The portion of the intumescent coating provided on the rear portion of the combustible heat source may be provided in the same discontinuous pattern as the portion of the intumescent coating provided on the front portion of the combustible heat source. The portion of the intumescent coating provided on the rear portion of the combustible heat source may be provided in a different discontinuous pattern as the portion of the intumescent coating provided on the front portion of the combustible heat source.

Where the intumescent coating is provided on substantially the entire length of the combustible heat source, the portion of the intumescent coating provided on the front portion of the combustible heat source may be applied in a continuous layer while the portion of the intumescent coating provided on the rear portion of the combustible heat source may be in a discontinuous pattern.

The portion of the intumescent coating provided on the rear portion of the combustible heat source may be provided directly on the combustible heat source such that the intumescent coating is in direct contact with the combustible heat source. In this case, the intumescent coating may advantageously act to retain the wrapper onto the rear portion of the combustible heat source.

The portion of the intumescent coating provided on the rear portion of the combustible heat source may not be in direct contact with the rear portion of the combustible heat source. The portion of the intumescent coating provided on the rear portion of the combustible heat source may be radially separated from the rear portion of the combustible heat source by one or more intermediate components. For example, the portion of the intumescent coating provided on the rear portion of the combustible heat source may be radially separated from the rear portion of the combustible heat source by the wrapper. The portion of the intumescent coating provided on the rear portion of the combustible heat source may be radially separated from the rear portion of the combustible heat source by a different component.

Where the intumescent coating is provided on substantially the entire length of the combustible heat source, the intumescent coating may contact the rear portion of the combustible heat source indirectly via one or more intermediate components. The intumescent coating may be in direct contact with the rear portion of the combustible heat source.

Where the intumescent coating is provided in a discontinuous pattern on the front portion or the rear portion of the combustible heat source, the intumescent coating may also be provided on substantially the entire length of the front portion of the combustible heat source. In this case, the discontinuous pattern, including any intervals or spaces, is provided on at least 80 percent of the length of the combustible heat source as described above. For example, where the intumescent coating is provided in a discontinuous pattern of a series of transverse lines about the combustible heat source, the intumescent coating may still be considered to be provided on substantially the entire length of the combustible heat source provided the discontinuous pattern, including the intervals or spaces, is provided on at least 80 percent of the length of the combustible heat source.

The intumescent coating may comprise a first intumescent coating on the front portion of the combustible heat source, and a second intumescent coating on the rear portion of the combustible heat source, wherein the first and second intumescent coatings are formed from different intumescent materials.

This advantageously allows the materials used for the intumescent coatings on both the front portion of the combustible heat source and the rear portion of the combustible heat source to be selected as desired based on their specific function. For example, the materials may be selected to optimise the heat insulating properties of the heat insulating layer formed on the front portion of the combustible heat source by the first intumescent coating, to optimise the adhesive or retentive properties of the second intumescent coating to the wrapper on the rear portion of the combustible heat source.

The intumescent coating may comprise any intumescent material. The intumescent coating may comprise one or more of a hard char, a soft char, expandable paper, intumescent paint, an expandable binder, an intumescent glue, a sodium silicate glue, and a blowing agent containing a plurality of thermally insulating particles or fibres.

Examples of suitable hard chars include, but are not limited to graphite, mixtures of sugar and bicarbonate, charmor, and melamine polyimide composite intumescent. Examples of suitable soft chars include, but are not limited to ammonium polyphosphate, and styrene acrylate. When soft chars expand in response to an elevated temperature, they form a light char which typically consists of a microporous carbonaceous foam formed by a chemical reaction. The light char is a poor conductor of heat which contributes to the insulating effect of the intumescent coating. Additionally, the soft char may comprise hydrates which provide an additional cooling effect when the soft char is heated.

Expandable paper may be a ceramic fibre based paper containing an expandable binder. Firemaster Expanding Paper ISW30 (available from Morgan Advanced Materials) is an example of such a suitable expanding paper.

Blowing agents may be materials which are gaseous at the temperature at which the intumescent coating is configured to expand but are solid at room temperature, or which thermally decompose at the temperature at which the intumescent coating is configured to expand to produce a gas, for example carbon dioxide gas. Examples of this type of blowing agent include, but are not limited to pentane and chlorofluorocarbons. Alternatively, blowing agents may be materials which produce gas as a result of chemical reactions which are initiated at the temperature at which the intumescent coating is configured to expand. Examples of this type of blowing agent include, but are not limited to baking powder, azodicarbonamide, titanium hydride, and isocyanates.

Where the intumescent coating is formed from a sodium silicate glue, the sodium silicate glue may have a molar ratio of from about 2 to about 3.5 parts $SiO_2$ to 1 part $Na_2O$.

The expansion of an intumescent material typically results in a corresponding decrease in the density of the material. One or more of a number of mechanisms may account for the expansion of an intumescent material upon exposure to elevated temperatures. For example, the intumescent material may expand due to the expansion of gas trapped within the material. The intumescent material may expand as a result of gas produced within the material as a result of the elevated temperature, for example, such as water vapour released from a hydrate.

The intumescent coating may have an expansion ratio of at least about 1.5:1. Preferably from about 1.5:1 to about 8:1, when heated from 20 degrees Celsius to 700 degrees Celsius at 1 atmosphere (101 kPa) of pressure.

As used herein with reference to the invention, the term "expansion ratio" refers to the ratio of the thickness of the intumescent coating before expansion to the thickness of the intumescent coating after expansion.

The provision of an intumescent coating having an expansion ratio below about 1.5:1 may have a minimal impact on reducing the temperature of the external surface of an aerosol-generating article comprising the multi-segment component. Conversely, the use of an intumescent coating having an expansion ratio greater than about 8:1 may result in an unacceptable change in the appearance of the multi-segment component when it is exposed to elevated temperatures.

The intumescent coating may have a thickness of from about 100 micrometres to about 2 millimetres. For example the intumescent coating may have a thickness of from about 200 micrometres to about 1 millimetre, or from about 100 micrometres to about 0.6 millimetres.

The "thickness" of the intumescent coating refers to the dimension of the layer in the transverse direction. The thickness of the intumescent coating is the dimension of the layer in the transverse direction before expansion of the intumescent material upon exposure to elevated temperatures to form a heat insulating layer.

An intumescent coating having thickness less than about 100 micrometres may have a minimal impact on reducing the temperature of the external surface of an aerosol-generating article comprising the multi-segment component. Conversely, the use of an intumescent coating having a thickness greater than about 2 millimetres may result in an unacceptable change in the appearance of the multi-segment component when it is exposed to elevated temperatures.

The greater the thickness of the intumescent coating, the more energy from the combustible heat source may be dissipated in the expansion of the intumescent material, resulting in less heat energy being transferred to the aerosol-forming substrate. Consequently, the use of an intumescent coating which is thicker than about 2 millimetres may reduce heat transfer from the combustible heat source to the aerosol-forming substrate.

The insulating layer formed by the intumescent coating may be porous.

This may advantageously provide additional insulation and reduce heat transfer between the combustible heat source and the outer surface of the multi-segment component by reducing heat transfer by conduction. The pores may be open or closed.

As used herein with reference to the invention, the term "closed pores" means that the pores in the insulating layer are not interconnected such that they do not allow air to pass from one side of the layer to the other side of the layer.

As used herein with reference to the invention, the term "open pores" means that the pores in the insulating layer are interconnected such that air is able to pass from one side of the layer to the other side of the layer.

Where the insulating layer comprises open pores, the pores may allow oxygen through the insulating layer and to the combustible heat source. This may advantageously facilitate the combustion of the combustible heat source, maintain correct combustion temperatures and improve heat transfer to the aerosol-forming substrate.

The front portion of the combustible heat source may have any length.

The front portion of the combustible heat source may have a length of at least 25 percent of the total length of the combustible heat source, for example the front portion of the combustible heat source may have a length of at least 35 percent, or at least 45 percent of the total length of the combustible heat source.

The front portion of the combustible heat source may have a length of no more than 60 percent of the total length of the combustible heat source, or no more than 55 percent, or no more than 50 percent of the total length of the combustible heat source.

For example, the front portion of the combustible heat source may have a length between about 25 percent and about 60 percent of the total length of the combustible heat source.

The multi-segment component comprises a wrapper circumscribing a rear portion of the combustible heat source and at least a front portion of the aerosol-forming substrate. The wrapper may be formed from one or more elements. For example, the wrapper may be formed from a single sheet of material.

The wrapper may comprise one or more layers of heat-conductive material. Preferably, the one or more layers of heat-conductive material are positioned around at least a rear portion of the combustible heat source and at least a front portion of the aerosol-forming substrate. In such embodiments, the heat-conductive material provides a thermal link between the combustible heat source and the aerosol-forming substrate and advantageously helps to facilitate adequate heat transfer from the combustible heat source to the aerosol-forming substrate to provide an acceptable aerosol. The heat-conductive material may be in direct contact with one or both of the combustible heat source and the aerosol-forming substrate. The layer of heat-conductive material may be spaced apart from one or both of the combustible heat source and the aerosol-forming substrate, such that there is no direct contact between the heat-conductive material and one or both of the combustible heat source and the aerosol-forming substrate.

As used herein with reference to the invention, the term "heat-conductive material" is used to describe a material having a bulk thermal conductivity of at least about 10 W per metre Kelvin (W/(m K)) at 23° C. and a relative humidity of 50% as measured using the modified transient plane source (MTPS) method.

The one or more layers of heat-conductive material are preferably non-combustible. In certain embodiments, the one or more layers of heat-conductive material may be oxygen restricting. In other words, the one or more layers of heat-conductive material may inhibit or resist the passage of oxygen through the wrapper.

As used herein with reference to the invention, the term "non-combustible" is used to describe a material that is substantially non-combustible at temperatures reached by the combustible heat source during combustion and ignition thereof.

Suitable heat-conductive materials for use in multi-segment components according to the invention include, but are not limited to: metal foil wrappers such as, for example, aluminium foil wrappers, steel wrappers, iron foil wrappers and copper foil wrappers; and metal alloy foil wrappers.

In some embodiments, the wrapper comprises one or more layers of heat-insulative material. With this arrangement, the heat-insulative material reduces the heat transfer from the combustible heat source to an outer surface of the wrapper, which can reduce the temperature of the surface of aerosol-generating article. Preferably, the heat-insulative material is non-combustible. Inclusion of a non-combustible, heat insulating layer advantageously helps to reduce the ignition propensity of aerosol-generating articles comprising multi-segment components according to the invention by reducing the temperature of the surface of the aerosol-generating article.

As used herein with reference to the invention, the term "heat-insulative material" is used to describe a material having a bulk thermal conductivity of less than about 50 milliwatts per metre Kelvin (mW/(m K)) at 23 degrees Celsius and a relative humidity of 50% as measured using the modified transient plane source (MTPS) method.

The wrapper may be a laminate wrapper formed from a plurality of layers.

The wrapper may comprise a radially outer layer of heat-conductive material and a radially inner layer of heat-insulative material. In some embodiments, the wrapper comprises a radially inner layer of heat-conductive material and a radially outer layer of heat-insulative material. Other arrangements are possible. In preferred arrangements, the wrapper may advantageously conduct heat from the combustible heat source to the aerosol-forming substrate, while controlling radiative heat loss from the combustible heat source and the combustible heat source.

The combustible heat source may be a combustible carbonaceous heat source.

As used herein with reference to the invention, the term "carbonaceous" is used to describe a combustible heat source comprising carbon. Preferably, the combustible heat source is a solid combustible heat source.

The combustible heat source is preferably a blind combustible heat source. As used herein with reference to the invention the term "blind" describes a heat source that does not comprise any airflow channels extending from the front end face to the rear end face of the combustible heat source. As used herein with reference to the invention, the term "blind" is also used to describe a combustible heat source including one or more airflow channels extending from the front end face of the combustible heat source to the rear end face of the combustible heat source, wherein a combustible substantially air impermeable barrier between the rear end face of the combustible heat source and the aerosol-forming substrate barrier prevents air from being drawn along the length of the combustible heat source through the one or more airflow channels.

Where the combustible heat source is a blind combustible heat source, and where the intumescent coating is provided on substantially the entire length of the combustible heat source, the intumescent coating may advantageously compensate for the surface roughness or geometry defects of the combustible heat source and may reduce the bypass of combustion gases around the combustible heat source.

This can have the advantage that the intumescent coating prevents the bypass of combustible gases around the heat source. Consequently, the resistance-to-draw, or "RTD", of the aerosol-generating article may be maintained. Where the multi-segment component includes one or more air inlets through which air may be drawn into the aerosol-forming substrate, this arrangement ensures that substantially all of the airflow during use enters the aerosol-forming substrate through the air inlets, for desirable aerosol properties.

Multi-segment components according to the invention may comprise one or more air inlets downstream of the rear end face of the combustible heat source for drawing air into the one or more airflow pathways.

The combustible heat source may comprise at least one ignition aid.

As used herein, the term "ignition aid" is used to denote a material that releases one or both of energy and oxygen during ignition of the combustible heat source.

As used herein, the term "ignition aid" is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term "ignition aid" is also used to denote an elemental metal that releases energy during ignition of the combustible heat source, wherein the ignition temperature of the elemental metal is below about 500 degrees Celsius and the heat of combustion of the elemental metal is at least about 5 kJ/g.

As used herein, the term "ignition aid" does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

Examples of suitable ignition aids include, but are not limited to: nitrates; chlorates; perchlorates; bromates; bromites; borates; ferrates; ferrites; manganates; permanganates; organic peroxides; inorganic peroxides; superoxides; carbonates; iodates; periodates; iodites; sulphates; sulfites; other sulfoxides; phosphates; phospinates; phosphites; and phosphanites. The at least one ignition aid may comprise calcium peroxide.

In certain preferred embodiments, multi-segment components according to the invention comprising blind combustible heat sources comprise one or more air inlets located proximate to the downstream end of the aerosol-forming substrate.

In use, air drawn along the one or more airflow pathways of aerosol-generating articles including multi-segment components according to the invention comprising a blind combustible heat source for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. The impact of a user's puffing regime on the composition of the mainstream aerosol may be advantageously minimised or reduced.

The inclusion of a blind combustible heat source may advantageously substantially prevent or inhibit combustion and decomposition products and other materials formed during ignition and combustion of the blind combustible heat source from entering air drawn through multi-segment components according to the invention during use thereof. This is particularly advantageous where the blind combustible heat source comprises one or more ignition aids.

In multi-segment components according to the invention comprising a blind combustible heat source, heat transfer from the blind combustible heat source to the aerosol-forming substrate occurs primarily by conduction and heating of the aerosol-forming substrate by forced convection is minimised or reduced. This may advantageously help to minimise or reduce the impact of a user's puffing regime on the composition of the mainstream aerosol of aerosol-generating articles according to the invention.

In multi-segment components according to the invention comprising a blind combustible heat source, it is particularly important to optimise the conductive heat transfer between the combustible heat source and the aerosol-forming substrate. As described further below, the inclusion of one or more heat-conducting elements around at least a rear portion of the combustible carbonaceous heat source and at least a front portion of the aerosol-forming substrate is particularly preferred in multi-segment components according to the invention including blind heat sources, where there is little if any heating of the aerosol-forming substrate by forced convection.

It will be appreciated that multi-segment components according to the invention may comprise blind combustible heat sources comprising one or more closed or blocked passageways through which air may not be drawn for inhalation by a user.

For example, multi-segment components according to the invention may comprise blind combustible heat sources comprising one or more closed passageways that extend from the front end face at the upstream end of the blind combustible carbonaceous heat source only part way along the length of the blind combustible carbonaceous heat source.

The inclusion of one or more closed air passageways increases the surface area of the blind combustible heat source that is exposed to oxygen from the air and may advantageously facilitate ignition and sustained combustion of the blind combustible heat source.

In certain embodiments of the invention, the combustible heat source comprises at least one longitudinal airflow channel, which provides one or more airflow pathways through the heat source.

As used herein with reference to the invention, the term "airflow channel" is used to describe a channel extending along the length of the heat source through which air may be drawn through the aerosol-generating article for inhalation by a user.

The diameter of the at least one longitudinal airflow channel may be between about 1.5 mm and about 3 mm, more preferably between about 2 mm and about 2.5 mm. The inner surface of the at least one longitudinal airflow channel may be partially or entirely coated, as described in more detail in WO 2009/022232 A1.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise one or more aerosol formers. Examples of suitable aerosol formers include, but are not limited to, glycerine and propylene glycol.

In some embodiments, the aerosol-forming substrate is a rod comprising a tobacco-containing material.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper may be considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghetti strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

The aerosol-forming substrate preferably has a length of between about 5 mm and about 20 mm. In certain embodiments, the aerosol-forming substrate may have a length of between about 6 mm and about 15 mm or a length of between about 7 mm and about 12 mm.

In preferred embodiments, the aerosol-forming substrate comprises a plug of tobacco-based material wrapped in a plug wrap. In particularly preferred embodiments, the aerosol-forming substrate comprises a plug of homogenised tobacco-based material wrapped in a plug wrap.

In any of the above embodiments, the combustible heat source and the aerosol-forming substrate may be in abutting coaxial alignment. Where the intumescent coating is provided on the rear portion of the combustible heat source, the intumescent coating the can retain the combustible heat source in direct contact with the aerosol-forming substrate during use to ensure a good thermal connection between the two components and to maintain the temperature of the aerosol-forming substrate within a desired range.

Where the aerosol-forming substrate comprises a plug of tobacco-based material wrapped in a plug wrap, the intumescent coating may be provided on at least a portion of the aerosol-forming substrate. For example, the intumescent coating may be provided on a front portion of the aerosol-forming substrate. The intumescent coating provided on at least a portion of the aerosol-forming substrate may be the same as the intumescent coating provided on all or part of the front portion of the combustible heat source. The intumescent coating provided on at least a portion of the aerosol-forming substrate may be different from the intumescent coating provided on all or part of the front portion of the combustible heat source. The intumescent coating provided on at least a portion of the aerosol-forming substrate may be provided in a discontinuous pattern. The intumescent coating may be provided on substantially the entire length of the aerosol-forming substrate.

Where the intumescent coating is provided on the front portion of the combustible heat source, the rear portion of the combustible heat source, and at least a portion of the aerosol-forming substrate, the intumescent coating may comprise a first, second, and third intumescent coating. The first, second, and third intumescent coatings may comprise different intumescent materials. The first, second, and third intumescent coatings may comprise the same intumescent material.

As used herein with reference to the invention, the terms "abutting" and "abut" are used to describe a component, or a portion of a component, being in direct contact with another component, or portion of a component.

Multi-segment components according to the invention may comprise a heat-conducting element around and in direct contact with both at least a rear portion of the combustible heat source and at least a front portion of the aerosol-forming substrate. The heat-conducting element is separate from, and provided in addition to the wrapper circumscribing a rear portion of the combustible heat source and at least a front portion of the aerosol-forming substrate. In such embodiments, the heat-conducting element provides a thermal link between the combustible heat source and the aerosol-forming substrate of aerosol-generating articles according to the invention and advantageously helps to facilitate adequate heat transfer from the combustible heat source to the aerosol-forming substrate to provide an acceptable aerosol.

Multi-segment components according to the invention may comprise a heat-conducting element spaced apart from one or both of the combustible heat source and the aerosol-forming substrate, such that there is no direct contact between the heat-conducting element and one or both of the combustible heat source and the aerosol-forming substrate.

The one or more heat-conducting elements are preferably non-combustible. In certain embodiments, the one or more heat-conducting elements may be oxygen restricting. In other words, the one or more heat-conducting elements may inhibit or resist the passage of oxygen through the heat-conducting element.

Suitable heat-conducting elements for use in multi-segment components according to the invention include, but are not limited to: metal foil wrappers such as, for example, aluminium foil wrappers, steel wrappers, iron foil wrappers and copper foil wrappers; and metal alloy foil wrappers.

Multi-segment components according to the invention may further comprise a cap configured to at least partially cover the front end face of the combustible heat source, wherein the cap is removable to expose the front end face of the combustible heat source prior to use of the aerosol-generating article.

As used herein with reference to the invention, the term "cap" refers to a protective cover that substantially surrounds the distal end of the multi-segment component, including the front end face. Providing a cap that is removed prior to ignition of the combustible heat source advantageously protects the combustible heat source prior to use.

For example, multi-segment components according to the invention may comprise a removable cap attached at a line of weakness to the distal end of the aerosol-generating article, wherein the cap comprises a cylindrical plug of material circumscribed by a wrapper as described in WO 2014/086998 A1.

Multi-segment components according to the invention may further comprise a transfer element, or spacer element, downstream of the aerosol-forming substrate. Such an element may take the form of a hollow tube that is located downstream of an aerosol-forming substrate.

The transfer element may abut the aerosol-forming substrate. Alternatively, the transfer element may be spaced apart from the aerosol-forming substrate. The transfer element may be coaxial alignment with one or both of the combustible heat source and the aerosol-forming substrate.

The inclusion of a transfer element advantageously allows cooling of the aerosol generated by heat transfer from the combustible heat source to the aerosol-forming substrate. The inclusion of a transfer element advantageously allows the overall length of an aerosol-generating article comprising a multi-segment component according to the invention to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the aerosol-generating article, and the presence and length of other components within the multi-segment component or an aerosol-generating article comprising the multi-segment component.

Preferably, the transfer element comprises at least one open-ended tubular hollow body. In such embodiments, in use, air drawn into the aerosol-generating article passes through the at least one open-ended tubular hollow body as it passes downstream through the aerosol-generating article.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Multi-segment components according to the invention may further comprise an aerosol-cooling element or heat exchanger downstream of the aerosol-forming substrate. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

The wrapper may be formed from any suitable material or combination of materials. Suitable materials are well known in the art and include, but are not limited to, cigarette paper.

According to a second aspect of the present invention, there is provided an aerosol-generating article comprising the multi-segment component of the first aspect of the present invention, and a mouthpiece downstream of the multi-segment component.

The combustible heat source is located at or proximate to the distal end of the aerosol-generating article. The mouth end of the aerosol-generating article is downstream of the distal end of the aerosol-generating article.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may comprise a filter comprising one or more segments comprising suitable known filtration materials. Suitable filtration materials are known in the art and include, but are not limited to, cellulose acetate and paper. The mouthpiece may comprise one or more segments comprising absorbents, adsorbents, flavourants, and other aerosol modifiers and additives or combinations thereof.

Aerosol-generating articles according to the invention may comprise a multi-segment component according to any of the embodiments described above and a mouthpiece segment at a downstream end of the multi-segment component.

Aerosol-generating articles according to the present invention may be substantially cylindrical in shape. The aerosol-generating article may be substantially elongate. The aerosol-generating article has a length and a circumference substantially perpendicular to the length.

The aerosol-forming substrate may be substantially cylindrical in shape. The aerosol-forming substrate may be substantially elongate. The aerosol-forming substrate has a length and a circumference substantially perpendicular to the length. The aerosol-forming substrate may be located in the aerosol-generating article such that the length of the aerosol-forming substrate is substantially parallel to the airflow direction in the aerosol-generating article.

Aerosol-generating articles according to the invention may have any desired length. For example, aerosol-generating articles according to the invention may have a total length of between approximately 65 mm and approximately 100 mm.

Aerosol-generating articles according to the invention may have any desired external diameter. For example, aerosol-generating articles according to the invention may have an external diameter of between approximately 5 mm and approximately 12 mm.

As used herein with reference to the invention, the term "diameter" refers to the maximum transverse dimension of aerosol-generating articles, multi-segment components, or portions of aerosol-generating articles, or multi-segment components according to the invention.

Aerosol-generating articles according to the invention may be assembled using known methods and machinery.

There is further provided a method of manufacturing a multi-segment component for an aerosol-generating article, comprising the steps of: providing a combustible heat source; applying an intumescent coating to all or part of the combustible heat source; the intumescent coating being configured to form a heat insulating layer on all or part of the combustible heat source in response to heating by the combustible heat source.

The method may further comprise steps of providing an aerosol-forming substrate downstream of the combustible heat source; applying a wrapper to a rear portion of the combustible heat source and at least a front portion of the aerosol-forming substrate wherein a front portion of the combustible heat source extends beyond the wrapper so that the front portion of the combustible heat source is exposed during use, and wherein the intumescent coating is provided on all or part of the front portion of the combustible heat source.

The step of applying an intumescent coating to all or part of the combustible heat source may be performed after the step of applying a wrapper to a rear portion of the combustible heat source and at least a front portion of the aerosol-forming substrate. Alternatively, the step of applying an intumescent coating to all or part of the combustible heat source may be performed before the step of applying a wrapper to a rear portion of the combustible heat source and at least a front portion of the aerosol-forming substrate.

The step of applying an intumescent coating to all or part of the combustible heat source may be performed by one or more of spreading, spray coating, dip coating, using a glue gun, using a brush or a roller, using a nozzle, or rotogravure or other printing techniques. Where the intumescent material is a powder, it may be glued to the front portion of the combustible heat source using a glue or a binder.

The combustible heat source may comprise an ignition aid.

There is further provided a method of manufacturing a multi-segment component for an aerosol-generating article, comprising the steps of: providing a combustible heat source; providing an aerosol-forming substrate downstream of the combustible heat source; applying an intumescent coating to all or part of a front portion of the combustible heat source; applying a wrapper to a rear portion of the combustible heat source and at least the front portion of the aerosol-forming substrate; the intumescent coating being configured to form a heat insulating layer on a front portion of the combustible heat source in response to heating by the combustible heat source.

There is further provided a method of manufacturing an aerosol-generating article comprising the steps of providing a multi-segment component manufactured according to any of the methods described above, and providing a mouthpiece downstream of the multi-segment component. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece. The mouthpiece may comprise a filter comprising one or more segments comprising suitable known filtration materials. Suitable filtration materials are known in the art and include, but are not limited to, cellulose acetate and paper. The mouthpiece may comprise one or more segments comprising absorbents, adsorbents, flavourants, and other aerosol modifiers and additives or combinations thereof.

All scientific and technical terms used herein have meanings commonly used in the art unless otherwise specified.

The definitions provided herein are to facilitate understanding of certain terms used frequently herein.

Features described in relation to one or more aspects may equally be applied to other aspects of the invention. In particular, features described in relation to the multi-segment component of the first aspect may be equally applied to the aerosol-generating article of the second aspect, and vice versa. Additionally, features described in relation to the multi-segment component of the first aspect or the aerosol-generating article of the second aspect may be equally applied to the method of manufacture.

The invention will be further described, by way of example only, with reference to the accompanying drawings in which.

Figure 1:
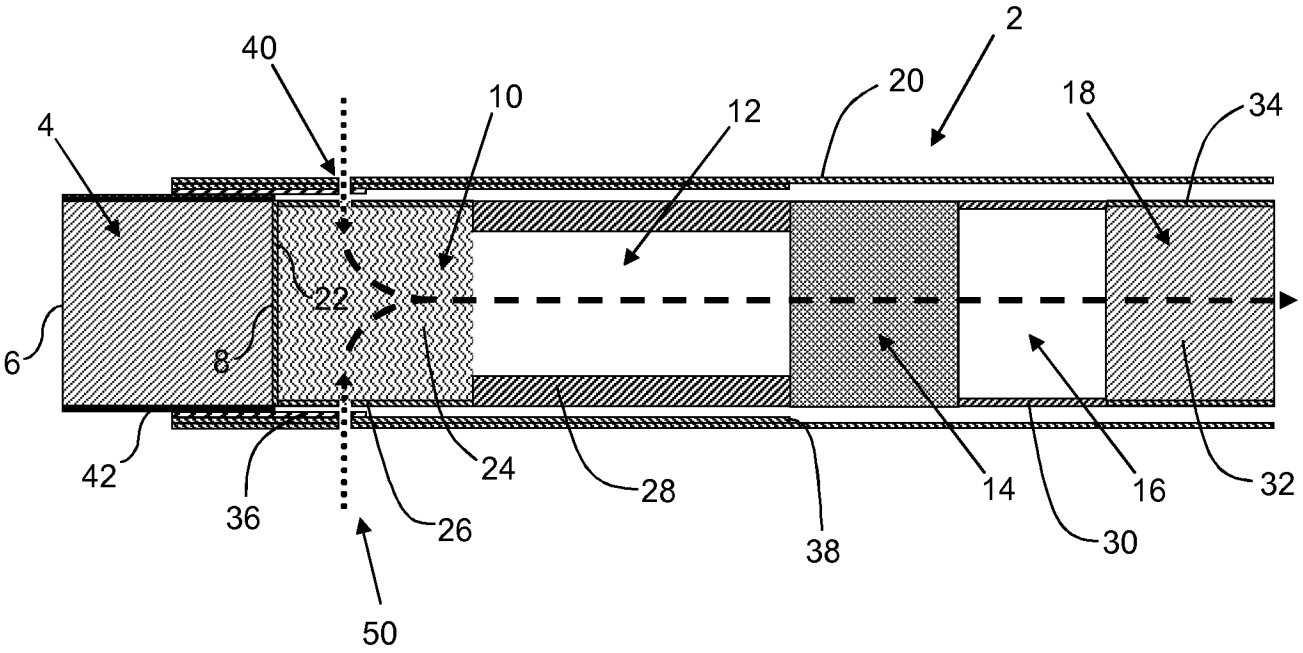
FIG. 1 shows a schematic longitudinal cross-sectional view of an aerosol-generating article having a multi-segment component according to a first embodiment of the invention.

The aerosol-generating article 2 according to the first embodiment of the invention shown in FIG. 1 comprises a multi-component segment 50 and a mouthpiece 18 downstream of the multi-component segment 50. The multi-component segment 50 comprises a blind combustible heat source 4 having a front face 6 and an opposed rear face 8, an aerosol-forming substrate 10 and a transfer element 12. The multi-component segment 50 further comprises an aerosol-cooling element 14 and a spacer element 16 disposed downstream of the aerosol-forming substrate 10.

The blind combustible heat source 4 is a blind carbonaceous combustible heat source and is located at the distal end of the aerosol-generating article 2. As shown in FIG. 1, a non-combustible substantially air impermeable barrier 22 in the form of a disc of aluminium foil is provided between the rear face 8 of the blind combustible heat source 4 and the aerosol-forming substrate 10. The barrier 22 is applied to the rear face 8 of the blind combustible heat source 4 by pressing the disc of aluminium foil onto the rear face 8 of the blind combustible heat source 4 and abuts the rear face 8 of the combustible carbonaceous heat source 4 and the aerosol-forming substrate 10.

In other embodiments of the invention (not shown), the non-combustible substantially air impermeable barrier 22 between the rear face 8 of the blind combustible heat source 4 and the aerosol-forming substrate 10 may be omitted.

The aerosol-forming substrate 10 is located immediately downstream of the barrier 22 applied to the rear face 8 of the blind combustible heat source 4. The aerosol-forming substrate 10 comprises a cylindrical plug of homogenised tobacco-based material 24 including an aerosol former such as, for example, glycerine, wrapped in plug wrap 26.

The transfer element 12 is located immediately downstream of the aerosol-forming substrate 10 and comprises a cylindrical open-ended hollow cellulose acetate tube 28.

The aerosol-cooling element 14 is located immediately downstream of the transfer element 12 and comprises a gathered sheet of biodegradable polymeric material such as, for example, polylactic acid.

The spacer element 16 is located immediately downstream of the aerosol-cooling element 14 and comprises a cylindrical open-ended hollow paper or cardboard tube 30.

The mouthpiece 18 is located immediately downstream of the spacer element 16. As shown in FIG. 1, the mouthpiece 18 is located at the proximal end of the aerosol-generating article 2 and comprises a cylindrical plug of suitable filtration material 32 such as, for example, cellulose acetate tow of very low filtration efficiency, wrapped in filter plug wrap 34.

As shown in FIG. 1, the aerosol-generating article 2 further comprises a single heat-conducting element 36 of suitable material such as, for example, aluminium foil, overlying a rear portion of the blind combustible heat source 4 and a front portion of the aerosol-forming substrate 10. In this embodiment, the single heat-conducting element 36 does not overlie any of the transfer element 12.

In other embodiments of the invention (not shown), the single heat-conducting element 36 may overlying a rear portion of the blind combustible heat source 4 and the entire length of the aerosol-forming substrate 10 and the entire length of the transfer element 12.

In other embodiments of the invention (not shown), the transfer element 12 may extend beyond the single heat-conducting element 36 in the downstream direction. That is the single heat-conducting element 36 may overlie only a front portion of the transfer element 12.

The single heat-conducting element 36 is circumscribed by a wrapper 38 of heat-insulative sheet material such as, for example, cigarette paper, of low air permeability, which is wrapped around the aerosol-forming substrate 10, transfer element 12 and a rear portion of the blind combustible heat source 4 to form a multi-segment component 50 of the aerosol-generating article 2.

The aerosol-cooling element 14, spacer element 16 may be circumscribed by a further wrapper (not shown). Alternatively, the aerosol-cooling element 14, spacer element 16 and mouthpiece 18 may be individual segments that are held together and connected to the multi-segment component 50 by the outer wrapper 20.

In other embodiments (not shown) the wrapper 38 may extend downstream of the transfer element 12 to circumscribe other components of the aerosol-generating article 2, such as the aerosol-cooling element 14 and the spacer element 16 which are then incorporated into the multi-segment component. The mouthpiece 18 may then be connected at the downstream end of the multi-segment component by outer wrapper 20, or by an additional wrapper or a band of tipping paper (not shown).

In the aerosol-generating article 2 according to the first embodiment of the invention shown in FIG. 1, the single heat-conducting element 36 and the wrapper 38 extend to approximately the same position on the blind combustible heat source 4 in the upstream direction such that the upstream ends of the single heat-conducting element 36 and the wrapper 38 are substantially aligned over the blind combustible heat source 4.

The portion of the blind combustible heat source 4 circumscribed by the wrapper 38 may be referred to as the rear portion of the combustible heat source 4. The portion of the combustible heat source 4 which extends beyond the wrapper 38 so that it is exposed during use may be referred to as the front portion of the combustible heat source 4

It will be appreciated that in other embodiments of the invention (not shown), the wrapper 38 may extend beyond the single heat-conducting element 36 in the upstream direction.

The aerosol-generating article 2 comprises one or more air inlets 38 around the periphery of the aerosol-forming substrate 10.

As shown in FIG. 1, a circumferential arrangement of air inlets 40 is provided in the plug wrap 26 of the aerosol-forming substrate 10, the wrapper 38 and the single heat-conducting element 36 to admit cool air (shown by dotted arrows in FIG. 1) into the aerosol-forming substrate 10.

The aerosol-generating article 2 further comprises an intumescent coating 42 provided on the combustible heat source 4. In the embodiment shown in FIG. 1, the intumescent coating 42 is provided on substantially the entire length of the combustible heat source 4. The intumescent coating 42 is provided on substantially the entire outer surface of the combustible heat source 4. The intumescent coating 42 is not provided on the front end face of the combustible heat source 4. In this embodiment, on the rear portion of the combustible heat source 4, the intumescent coating 42 is arranged on an inner surface of the heat-conducting element 36 such that it is indirect contact with the combustible heat source 4. In other examples (not shown), the intumescent coating 42 may be in contact with the rear portion of the combustible heat source 4 indirectly, for example via the heat-conducting element 36. The intumescent coating 42 circumscribes the combustible heat source 4 and is arranged to expand in response to heat from the combustible heat source 4. The intumescent coating 42 is formed from an intumescent inorganic glue. Suitable intumescent inorganic glues include sodium silicate glues, such as those available from PQ Corporation of Malvern, Pennsylvania, US.

The multi-segment component 50 may further comprise a removable cap (not shown) at its distal end and directly adjacent to the heat source 4. For example, the removable cap may comprise a central portion including a desiccant, such as glycerine, to absorb moisture as compared to the heat source, which is wrapped in a portion of one or both of the outer wrapper 20 and the wrapper 38 and connected to the rest of that wrapper along a line of weakness comprising a plurality of perforations in the wrapper. In such examples, to use the aerosol-generating article, the user removes the removable cap by transversely compressing the cap by pinching it between thumb and finger. By compressing the cap, sufficient force is provided to the line of weakness to locally break the wrapper by which the cap is connected. The user then removes the cap by twisting the cap to break the remaining portion of the line of weakness. When the cap is removed the heat source is partially exposed which enables the user to light the aerosol-generating article.

In use, a user ignites the blind combustible heat source 4 of the aerosol-generating article 2 according to the first embodiment of the invention and then draws on the mouthpiece 18. When a user draws on the mouthpiece 18, air (shown by dotted arrows in FIG. 1) is drawn into the aerosol-forming substrate 10 of the aerosol-generating article 2 through the air inlets 40.

The front portion of the aerosol-forming substrate 10 is heated by conduction through the rear face 8 of the blind combustible heat source 4 and the barrier 22.

The heating of the aerosol-forming substrate 10 by conduction releases glycerine and other volatile and semi-volatile compounds from the plug of homogenised tobacco-based material 24. The compounds released from the aerosol-forming substrate 10 form an aerosol that is entrained in the air drawn into the aerosol-forming substrate 10 of the aerosol-generating article 2 through the air inlets 40 as it flows through the aerosol-forming substrate 10. The drawn air and entrained aerosol (shown by dashed arrows in FIG. 1) pass downstream through the transfer element 12, aerosol-cooling element 14 and spacer element 16, where they cool and condense. The cooled drawn air and entrained aerosol pass downstream through the mouthpiece 18 and are delivered to the user through the proximal end of the aerosol-generating article 2 according to the first embodiment of the invention. The non-combustible substantially air impermeable barrier 22 on the rear face 8 of the blind combustible heat source 4 isolates the blind combustible heat source 4 from air drawn through the aerosol-generating article 2 such that, in use, air drawn through the aerosol-generating article 2 does not come into direct contact with the blind combustible heat source 4.

During heating of the intumescent coating 42 by the combustible heat source 4, the intumescent coating 42 expands. The expanded intumescent coating 42 provides a heat insulating layer on the outer surface of the combustible heat source 4. This reduces the temperature of the external surface of the aerosol-generating article 2 and facilitates a reduction in the potential risk of heat damage to adjacent materials caused by improper handling of the aerosol-generating article 2.

The intumescent coating 42 has an unexpanded thickness of from about 0.1 mm to about 2 mm and has an expansion ratio of from about 1.5:1 to about 8:1.

Features of further embodiments of the invention, described below, which are the same as features described above in relation to the first embodiment of the invention shown in FIG. 1, are identified using common reference numerals.

Figure 2:
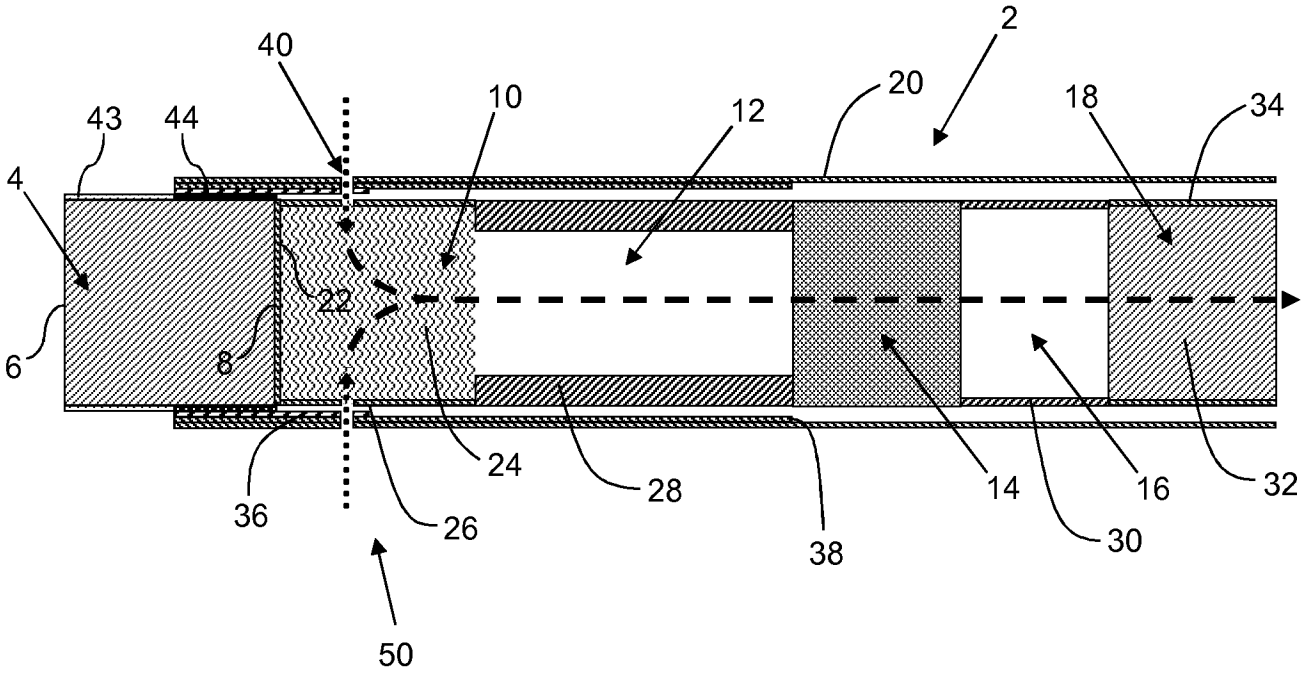
FIG. 2 shows a schematic longitudinal cross-sectional view of an aerosol-generating article having a multi-segment component according to a second embodiment of the invention.

An aerosol-generating article according to a second embodiment of the invention is shown in FIG. 2. In the second embodiment, the intumescent coating comprises a first intumescent coating 43 provided on a front portion of the combustible heat source 4, and a second intumescent coating 44 provided on a rear portion of the combustible heat source 4. Together, the first 43 and second 44 intumescent coatings are provided on substantially the entire outer surface of the combustible heat source 4. As a result, the substantially the entire outer surface of the combustible heat source 4 is provided with an intumescent coating 43, 44. The first 43 and second 44 intumescent coatings are formed from different intumescent materials. The material used in the first intumescent coating 43 is selected to optimise the heat insulating properties of the first intumescent coating 43, while the material used in the second intumescent coating 44 is selected to optimise the adhesive or retentive properties of the second intumescent coating so as to securely fix the combustible heat source in place.

Figure 3:
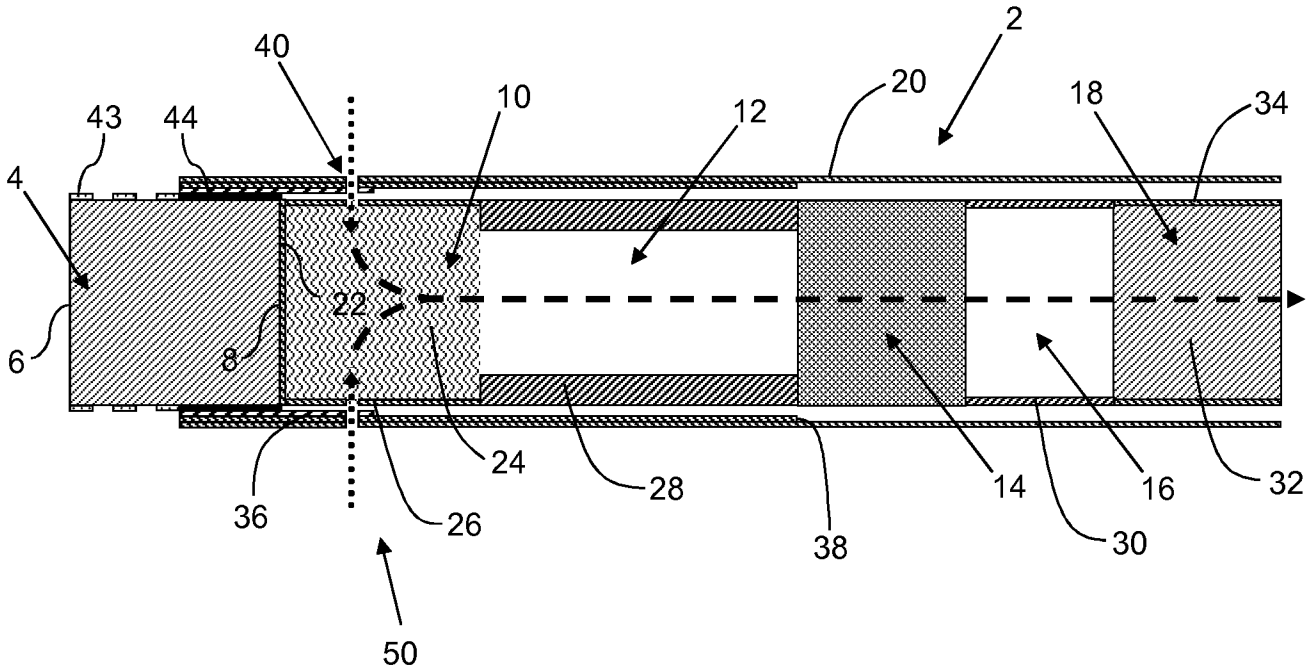
FIG. 3 shows a schematic longitudinal cross-sectional view of an aerosol-generating article having a multi-segment component according to a third embodiment of the invention.

An aerosol-generating article according to a third embodiment of the invention is shown in FIG. 3. In the third embodiment, the intumescent coating comprises a first intumescent coating 43 provided on a front portion of the combustible heat source 4 and a second intumescent coating 44 provided on a rear portion of the combustible heat source 4. The first intumescent coating 43 is provided in a discontinuous pattern, for example, as a series of rings about the circumferential surface of the front portion of the combustible heat source 4. As in the second embodiment, the first 43 and second 44 intumescent coatings are formed from different materials and the second intumescent coating 44 is provided on substantially the entire outer surface of the rear portion of the combustible heat source 4.

Figure 4:
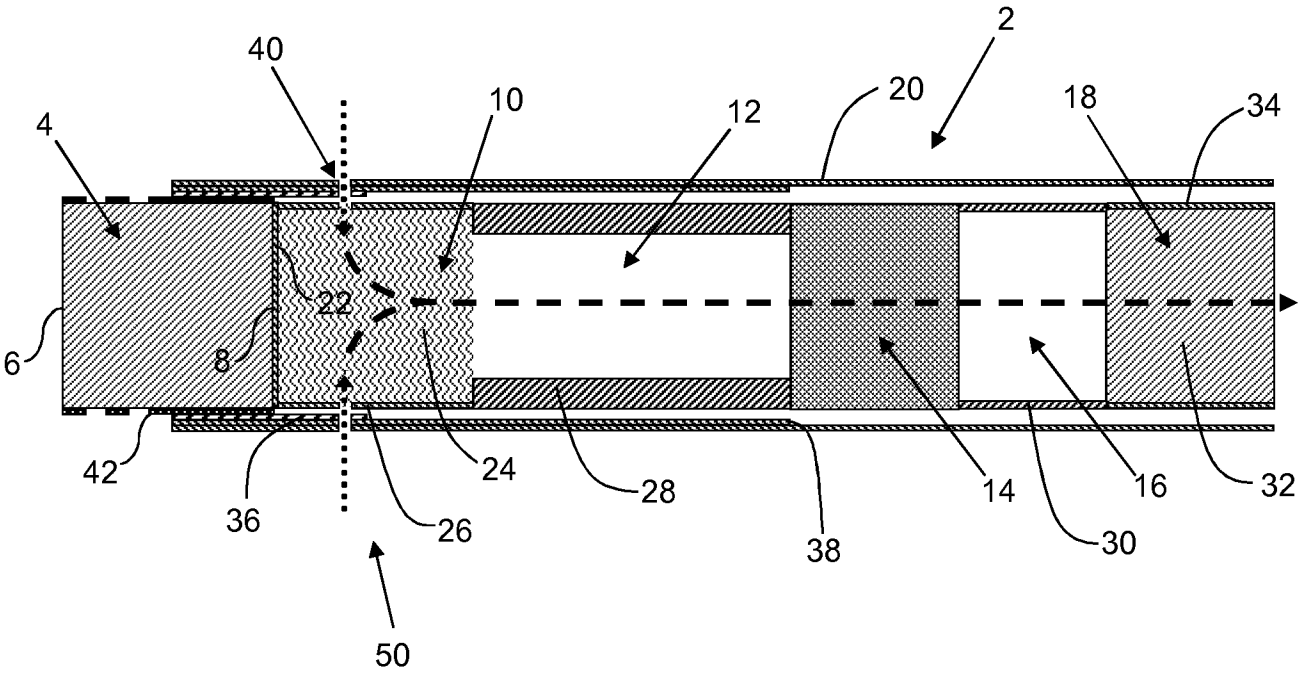
FIG. 4 shows a schematic longitudinal cross-sectional view of an aerosol-generating article having a multi-segment component according to a fourth embodiment of the invention.

An aerosol-generating article according to a fourth embodiment of the invention is shown in FIG. 4. In the fourth embodiment, an intumescent coating 42 is provided on both the front portion of the combustible heat source 4 and the rear portion of the combustible heat source 4. The intumescent coating 42 is provided on substantially the entire outer surface of the rear portion of the combustible heat source 4. The intumescent coating 42 is provided in a discontinuous pattern on the front portion of the combustible heat source 4.

Figure 5:
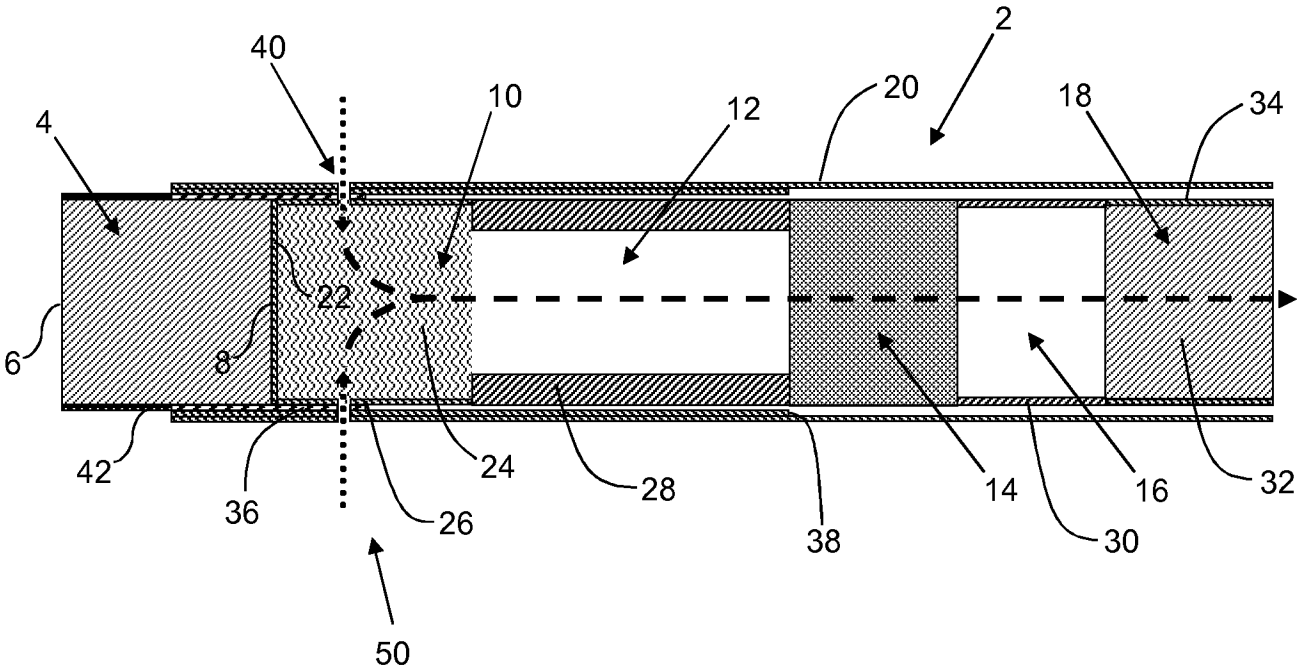
FIG. 5 shows a schematic longitudinal cross-sectional view of an aerosol-generating article having a multi-segment component according to a fifth embodiment of the invention.

An aerosol-generating article according to a fifth embodiment of the invention is shown in FIG. 5. In the fifth embodiment, an intumescent coating 42 is provided on only the front portion of the combustible heat source 4. The intumescent coating 42 is provided on substantially the entire outer surface of the front portion of the combustible heat source 4. The rear portion of the combustible heat source 4 is not provided with an intumescent coating. Instead, the single heat-conducting element 36 is in direct contact with the rear portion of the combustible heat source 4.

FIGS. 6 to 9 show combustible heat sources for use in a multi-segment component according to the present invention.

Figure 6:
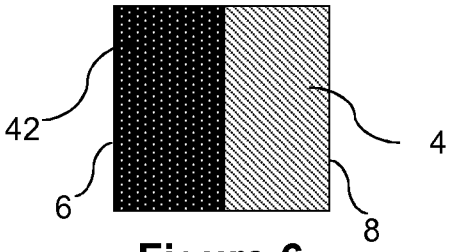
FIGS. 6 to 9 show schematic longitudinal views of combustible heat sources comprising an intumescent coating on at least the front portion of a combustible heat source, for use in a multi-segment component according to the present invention.

In the embodiment shown in FIG. 6, an intumescent coating 42 is provided on only the front portion of a combustible heat source 4. The intumescent coating 42 is provided on substantially the entire outer surface of the front portion of the combustible heat source 4. The rear portion of the combustible heat source 4 is not provided with an intumescent coating. The intumescent coating 42 is provided as a continuous layer. The intumescent coating 42 is not provided on substantially the entire length of the combustible heat source 4.

Figure 7A:
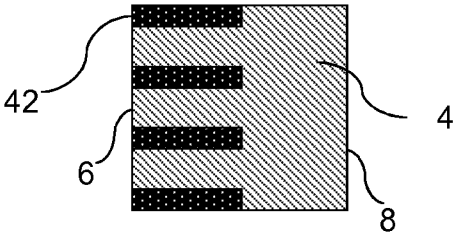
Figure 7B:
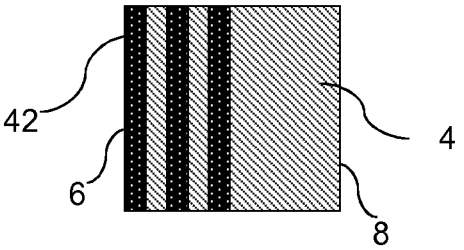
Figure 7C:
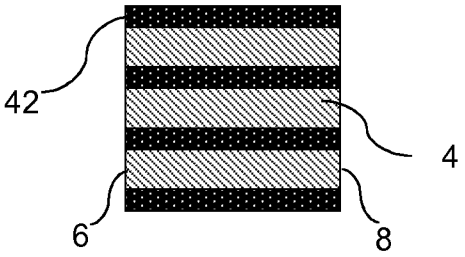
Figure 8:
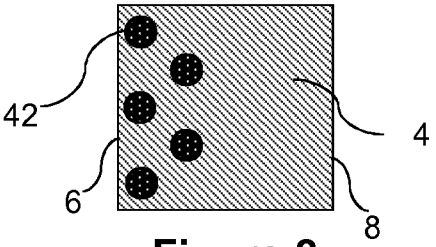
Figure 9:
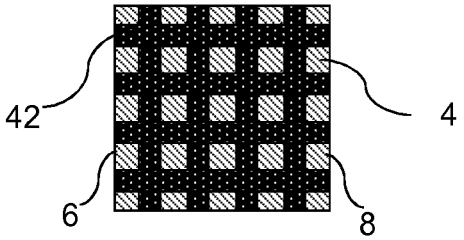

In the embodiments shown in FIGS. 7 to 9, an intumescent coating 42 is provided as a discontinuous pattern on substantially the entire outer surface of the front portion of the combustible heat source 4.

In the embodiments shown in FIG. 7, an intumescent coating 42 is provided as a series of parallel stripes. In FIGS. 7*a* and 7*b*, the intumescent coating 42 is provided on only the front portion of the combustible heat source 4. The intumescent coating 42 is not provided on substantially the entire length of the combustible heat source 4. In FIG. 7*a*, the intumescent coating 42 is provided as a series of longitudinal parallel stripes. In FIG. 7*b*, the intumescent coating 42 is provided as a series of transverse parallel stripes.

In FIG. 7*c*, an intumescent coating 42 is provided as a series of longitudinal stripes along the entire length of the combustible heat source 4. In FIG. 7*c*, the intumescent coating is provided in a discontinuous pattern on substantially the entire outer surface of the front portion of the combustible heat source, and on substantially the entire length of the combustible heat source.

In the embodiment shown in FIG. 8, an intumescent coating 42 is provided as a series of dots on the front portion of the combustible heat source 4. The rear portion of the combustible heat source 4 is not provided with an intumescent coating. The intumescent coating 42 is not provided on substantially the entire length of the combustible heat source 4.

In the embodiment shown in FIG. 9, an intumescent coating 42 is provided on both the front portion and the rear portion of a combustible heat source 4. The intumescent coating 42 is provided in a grid pattern. The intumescent coating 42 is provided on substantially the entire length of the combustible heat source 4. The intumescent coating 42 is provided on substantially the entire outer surface of the combustible heat source 4.

The specific embodiments and examples described above illustrate but do not limit the invention. It is to be understood that other embodiments of the invention may be made and the specific embodiments and examples described herein are not exhaustive.

The invention claimed is:

1. A multi-segment component for an aerosol-generating article, the multi-segment component comprising:

a combustible heat source;

an aerosol-forming substrate downstream of the combustible heat source; and a wrapper circumscribing a rear portion of the combustible heat source and at least a front portion of the aerosol-forming substrate, wherein a front portion of the combustible heat source extends beyond the wrapper so that the front portion of the combustible heat source is exposed during use; and an intumescent coating on all or part of the front portion of the combustible heat source, the intumescent coating being configured to form a heat insulating layer on the front portion of the combustible heat source in response to heating by the combustible heat source.

2. The multi-segment component according to claim 1, wherein the intumescent coating is provided on substantially an entire outer surface of the front portion of the combustible heat source.

3. The multi-segment component according to claim 1, wherein the intumescent coating is provided in a discontinuous pattern on the front portion of the combustible heat source.

4. The multi-segment component according to claim 3, wherein the discontinuous pattern comprises one or more lines, rings, dots, or other discrete geometric shapes of intumescent material, or any combination thereof.

5. The multi-segment component according to claim 1, wherein the intumescent coating is provided only on the front portion of the combustible heat source.

6. The multi-segment component according to claim 1, wherein the intumescent coating is provided on substantially an entire length of the combustible heat source.

7. The multi-segment component according to claim 6, wherein the intumescent coating comprises a first intumescent coating on the front portion of the combustible heat source, and a second intumescent coating on the rear portion of the combustible heat source, and wherein the first and the second intumescent coatings are formed from different intumescent materials.

8. The multi-segment component according to claim 1, wherein the intumescent coating has an expansion ratio of at least about 1.5:1, when heated from 20 degrees Celsius to 700 degrees Celsius at 1 atmosphere of pressure.

9. The multi-segment component according to claim 1, wherein the intumescent coating has an expansion ratio of from about 1.5:1 to about 8:1, when heated from 20 degrees Celsius to 700 degrees Celsius at 1 atmosphere of pressure.

10. The multi-segment component according to claim 1, wherein the intumescent coating has a thickness of from about 100 micrometres to about 2 millimetres.

11. The multi-segment component according to claim 1, wherein the intumescent coating has a thickness of from about 200 micrometres to about 1 millimetre.

12. The multi-segment component according to claim 1, wherein the heat insulating layer formed by the intumescent coating is porous.

13. The multi-segment component according to claim 1, wherein the front portion of the combustible heat source has a length of at least 25 percent of a total length of the combustible heat source.

14. The multi-segment component according to claim 1, wherein the wrapper comprises one or more layers of heat-conductive material.

15. An aerosol-generating article comprising a multi-segment component according to claim 14, and a mouthpiece disposed downstream of the multi-segment component.

* * * * *